US009638374B2

(12) United States Patent
Lambrix et al.

(10) Patent No.: US 9,638,374 B2
(45) Date of Patent: May 2, 2017

(54) LNG DISPENSER

(71) Applicant: BPC Acquisition Company, Spring Lake, MI (US)

(72) Inventors: Sarah Ann Lambrix, Grand Haven, MI (US); Chad Robert Paffhausen, Spring Lake, MI (US); Adam Kenneth Simon, Norton Shores, MI (US); Jonathan M Rathbun, Belmont, MI (US)

(73) Assignee: BPC Acquisition Company, Spring Lake, MI (US)

( * ) Notice: Subject to any disclaimer, the term of this patent is extended or adjusted under 35 U.S.C. 154(b) by 328 days.

(21) Appl. No.: 14/211,080

(22) Filed: Mar. 14, 2014

(65) Prior Publication Data

US 2014/0261867 A1 Sep. 18, 2014

Related U.S. Application Data

(60) Provisional application No. 61/790,380, filed on Mar. 15, 2013.

(51) Int. Cl.
*B65B 31/00* (2006.01)
*F17C 13/02* (2006.01)
(Continued)

(52) U.S. Cl.
CPC ..... *F17C 13/025* (2013.01); *F17C 5/007* (2013.01); *F17C 5/02* (2013.01); *F17C 2205/0326* (2013.01); *F17C 2205/0332* (2013.01); *F17C 2205/0364* (2013.01); *F17C 2205/0376* (2013.01); *F17C 2221/033* (2013.01); *F17C 2223/0161* (2013.01); *F17C 2223/033* (2013.01); *F17C 2225/0161* (2013.01);
(Continued)

(58) Field of Classification Search
CPC .... F17C 13/025; F17C 13/023; F17C 13/026; F17C 5/007; F17C 2250/0495; F17C 2250/0439; F17C 2250/043; F17C 2260/038
See application file for complete search history.

(56) References Cited

U.S. PATENT DOCUMENTS 5,360,139 A * 11/1994 Goode ..... F17C 5/007 141/18
5,628,349 A * 5/1997 Diggins ..... F17C 5/06 141/3

(Continued)

*Primary Examiner* — Jason K Niesz
(74) *Attorney, Agent, or Firm* — Price Heneveld LLP

(57) ABSTRACT

A method is provided for verifying integrity of a recirculation valve in a recirculation line of an LNG dispenser. The method includes: closing the recirculation valve and a fill valve in a supply line that supplies LNG; monitoring a mass of the LNG flowing through the recirculation line to ensure that the mass flowing therethrough is less than an acceptable threshold; and aborting any pending sales if the mass of the LNG flowing therethrough is not less than the acceptable threshold. According to another embodiment, a method is provided for verifying integrity of a vent valve in an LNG dispenser. The method includes: closing the vent valve and opening a fill valve in a supply line that supplies LNG; monitoring the pressure of the LNG within the fill hose to ensure that the pressure remains steady; and aborting any pending sales if the pressure does not remain steady.

20 Claims, 6 Drawing Sheets

(51) Int. Cl.
*F17C 5/02* (2006.01)
*F17C 5/00* (2006.01)

(52) U.S. Cl.
CPC .. *F17C 2225/033* (2013.01); *F17C 2250/032* (2013.01); *F17C 2250/036* (2013.01); *F17C 2250/043* (2013.01); *F17C 2250/0439* (2013.01); *F17C 2250/0443* (2013.01); *F17C 2250/0452* (2013.01); *F17C 2250/0478* (2013.01); *F17C 2250/0495* (2013.01); *F17C 2260/038* (2013.01); *F17C 2265/065* (2013.01); *F17C 2270/0139* (2013.01)

(56) References Cited

U.S. PATENT DOCUMENTS

2012/0125482 A1* 5/2012 Mori ..... F17C 5/007 141/98
2013/0037165 A1* 2/2013 Okawachi ..... F17C 5/06 141/4

* cited by examiner

LNG DISPENSER

CROSS-REFERENCE TO RELATED APPLICATION

This application claims priority to and the benefit under 35 U.S.C. §119(e) of U.S. Provisional Patent Application No. 61/790,380, filed on Mar. 15, 2013, entitled "IMPROVED LNG DISPENSER," by Sarah Ann Lambrix et al., the entire disclosure of which is incorporated herein by reference.

BACKGROUND OF THE INVENTION

The present invention generally relates to dispensers for dispensing liquid natural gas (LNG) to vehicles.

SUMMARY OF THE INVENTION

According to an embodiment of the present invention, an LNG dispenser is provided comprising: a vehicle fill hose having a nozzle configured for coupling to a vehicle tank, the nozzle being closed when not coupled to a vehicle tank; a supply line through which LNG is supplied from a natural gas farm to a vehicle tank through the vehicle fill hose; a mass flow meter provided for measuring a mass of LNG flowing through the supply line; a fill valve located in the supply line for controlling a flow of LNG through the supply line; a recirculation line branching from the supply line between the mass flow meter and the fill valve for recirculating LNG from the supply line back to the natural gas farm; a recirculation valve located in the recirculation line for controlling a flow of LNG through the recirculation line; a pressure sensor provided in the supply line for sensing a pressure of the LNG within the supply line and the vehicle fill hose; a vent line branching from the supply line between the pressure sensor and the fill valve for venting vapors from a vehicle tank; a vent valve located in the vent line for controlling a flow of vapors through the vent line; and a controller for controlling the fill valve, the vent valve, and the recirculation valve. The controller verifies integrity of the recirculation valve by closing the fill valve and the recirculation valve and monitoring the mass of the LNG flowing through the mass flow meter to ensure that the mass of the LNG flowing therethrough is less than an acceptable threshold, and wherein, if the mass of the LNG flowing through the mass flow meter is not less than the acceptable threshold, the controller aborts any pending sales and determines that the recirculation circuit may be faulty or have an unwanted leak. The controller verifies integrity of the vent valve, fill valve, safety relief valve, and the fill hose by closing the vent valve and opening the fill valve prior to connection of the fill hose to a vehicle and monitoring the pressure of the LNG within the fill hose to ensure that the pressure remains steady, and wherein, if the pressure does not remain steady, the controller aborts any pending sales and determines that the vent valve, fill valve, safety relief valve or fill hose may be faulty or have an unwanted leak.

According to another embodiment of the present invention, an LNG dispenser is provided comprising: a supply line through which LNG is supplied from a natural gas farm to a vehicle tank; a mass flow meter provided for measuring a mass of LNG flowing through the supply line; a recirculation line branching from the supply line downstream of the mass flow meter for recirculating LNG from the supply line back to the natural gas farm; a recirculation valve located in the recirculation line for controlling a flow of LNG through the recirculation line; and a controller for controlling the recirculation valve. The controller verifies integrity of the recirculation valve by closing the recirculation valve and monitoring the mass of the LNG flowing through the mass flow meter to ensure that the mass of the LNG flowing therethrough is less than an acceptable threshold, and wherein, if the mass of the LNG flowing through the mass flow meter is not less than the acceptable threshold, the controller halts any sales.

According to another embodiment of the present invention, an LNG dispenser is provided comprising: a vehicle fill hose having a nozzle configured for coupling to a vehicle tank, the nozzle being closed when not coupled to a vehicle tank; a supply line through which LNG is supplied from a natural gas farm to a vehicle tank through the vehicle fill hose; a fill valve located in the supply line for controlling a flow of LNG through the supply line; a pressure sensor provided in the supply line for sensing a pressure of the LNG within a portion of the supply line downstream of said fill valve; a vent line branching from the supply line downstream of the fill valve for venting vapors from a vehicle tank; a vent valve located in the vent line for controlling a flow of vapors through the vent line; and a controller for controlling the fill valve and the vent valve. The controller verifies integrity of the vent valve, the fill valve, and the fill hose by closing the vent valve and opening the fill valve for a short period of time, typically less than 5 seconds, and then closing the fill valve to pressurize a portion of the lines which contain the fill valve, vent valve, pressure sensor, and fill hose prior to connection of the fill hose to a vehicle and monitoring the pressure of the LNG within the portion of lines to ensure that the pressure remains steady, and wherein, if the pressure does not remain steady, the controller halts any sales.

According to another embodiment of the present invention, a method is provided for verifying integrity of a valve in a line of an LNG dispenser, the method comprising: closing the valve; monitoring a mass of the LNG flowing through the line to ensure that the mass of the LNG flowing therethrough is less than an acceptable threshold; and halting any sales if the mass of the LNG flowing through the line is not less than the acceptable threshold. The valve may be a recirculation valve and the line may be a recirculation line.

According to another embodiment of the present invention, a method is provided for verifying integrity of a valve in a line of an LNG dispenser, the method comprising: prior to connection of a fill hose to a vehicle, closing the valve and opening a fill valve in a supply line that supplies LNG for a short period of time to pressurize a portion of the line that contains the valve, the pressure sensor and the fill hose; closing the fill valve; monitoring the pressure of the LNG within the pressurized portion of the line that contains the valve, the pressure sensor and the fill hose to ensure that the pressure remains steady; and halting any pending sales if the pressure does not remain steady. The valve may be a vent valve.

According to another embodiment of the present invention, an LNG dispenser is provided comprising: a supply line through which LNG is supplied from a natural gas farm to a vehicle tank; a temperature sensor provided for sensing a temperature of LNG flowing through the supply line; a recirculation line branching from the supply line downstream of the temperature sensor for recirculating LNG from the supply line back to the natural gas farm; a recirculation valve located in the recirculation line for controlling a flow of LNG through the recirculation line; and a controller for controlling the recirculation valve. Prior to delivery of LNG to the vehicle tank, the controller opens the recirculation valve while monitoring the temperature of the LNG sensed by the temperature sensor, and wherein the controller closes the recirculation valve when the temperature reaches a target temperature.

According to another embodiment of the present invention, an LNG dispenser is provided comprising: a supply line through which LNG is supplied from a natural gas farm to a vehicle tank; a temperature sensor provided for sensing a temperature of LNG flowing through the supply line; and a temperature display for displaying the temperature of the LNG as sensed by the temperature sensor.

According to another embodiment of the present invention, an LNG dispenser is provided comprising: a vehicle fill hose having a nozzle configured for coupling to a vehicle tank; a pressure sensor provided for sensing a pressure within the fill hose as well as in the vehicle tank when coupled thereto; and a pressure display for displaying the pressure within the vehicle tank as sensed by the pressure sensor.

According to another embodiment of the present invention, an LNG dispenser is provided comprising: a grounding strap provided for electrically grounding a vehicle into which LNG is to be dispensed; a grounding confirmation circuit coupled to the grounding strap for confirming that the grounding strap has been properly coupled to the vehicle; and a controller coupled to the grounding confirmation circuit for enabling dispensing of LNG to the vehicle when the grounding confirmation circuit confirms proper coupling of the grounding strap to the vehicle, and for disabling dispensing of LNG to the vehicle when the grounding confirmation circuit does not confirm proper coupling of the grounding strap to the vehicle.

These and other features, advantages, and objects of the present invention will be further understood and appreciated by those skilled in the art by reference to the following specification, claims, and appended drawings.

DETAILED DESCRIPTION OF THE EMBODIMENTS

Figure 1:
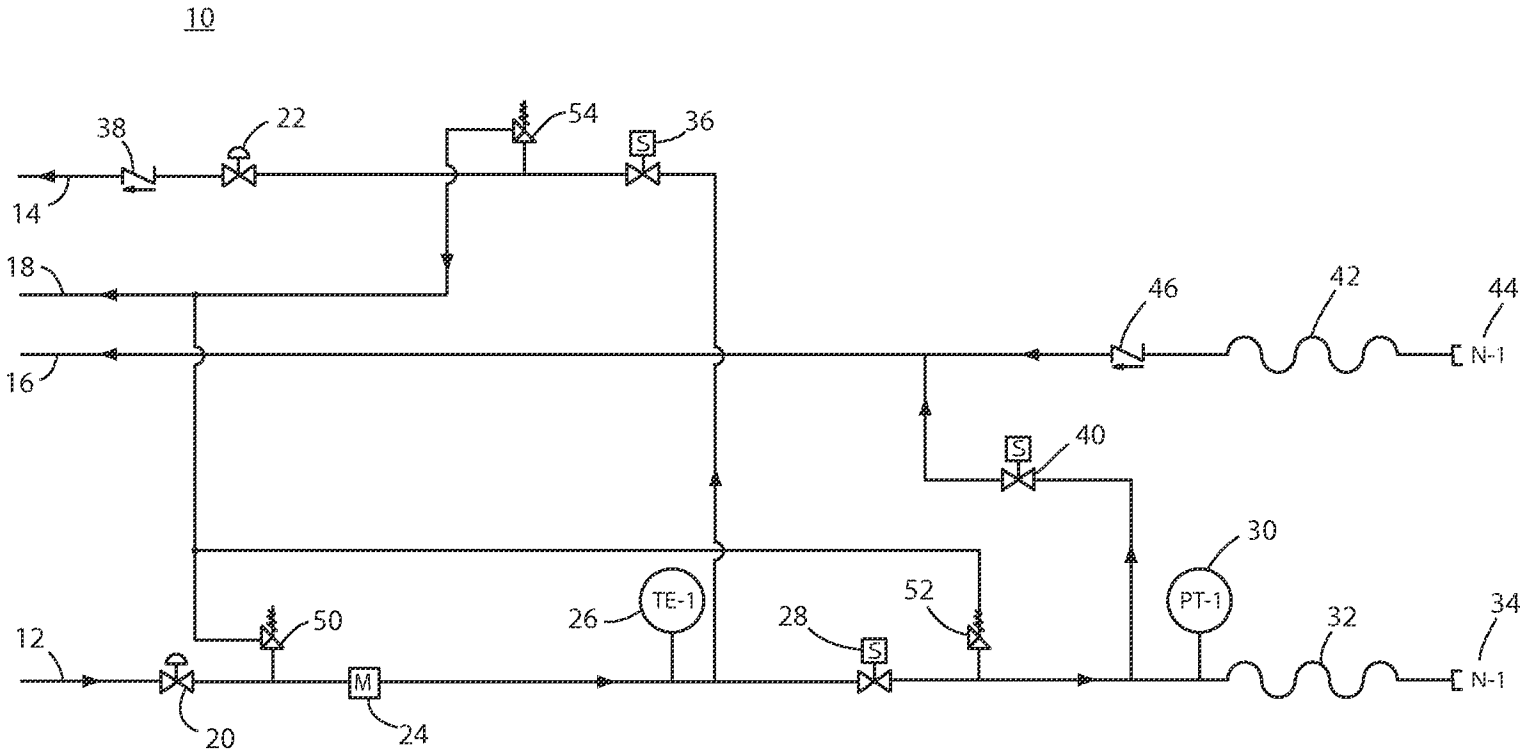
FIG. 1 is a flow diagram in schematic form of LNG flow control components of a dispenser according to some of the embodiments.

Reference will now be made in detail to the present preferred embodiments of the invention, examples of which are illustrated in the accompanying drawings. Wherever possible, the same reference numerals will be used throughout the drawings to refer to the same or like parts. In the drawings, the depicted structural elements are not to scale and certain components are enlarged relative to the other components for purposes of emphasis and understanding.

FIG. 1 is a flow diagram showing the LNG flow control components 10 of a dispenser 5. There are four lines shown that run between dispenser 5 and a natural gas farm 200 (FIG. 2) where the LNG is stored. The first line is a supply line 12 that supplies the LNG to the dispenser. The second line is a recirculation return line 14. The third line is a vent line 16 and the fourth line is a pressure relief line 18.

Dispenser 5 further includes manual valves 20 and 22 on supply line 12 and recirculation return line 14, respectively. A mass flow meter 24 is provided in supply line 12 for measuring the mass of LNG flowing through it. As discussed further below, meter 24 is electrically coupled to a dispenser controller 110 (FIG. 2), which reads meter data during various periods of operation.

A digital temperature sensor 26 reads the temperature of the LNG and supplies the temperature data to controller 110, as described further below.

Also in supply line 12 is a first pneumatically-actuated hydraulic valve or fill valve 28, which is controlled by controller 110 via an actuator valve **28*a*. Actuator valve 28*a* is an electrically-actuated pneumatic valve. The use of such a valve system allows the fill valve 28 to be located in the hazardous area of dispenser 5, while electrically-actuated pneumatic actuator valve 28*a* may be located in the electrical cabinet, which is protected from the hazardous area of dispenser 5**.

A digital pressure sensor 30 is also provided in supply line 12 proximate to vehicle fill line 32 for providing pressure readings to controller 110. At the end of vehicle fill line 32 is a nozzle 34 that has an integrated valve that opens when connected to a vehicle tank.

Recirculation return line 14 branches off of supply line 12 between temperature sensor 26 and first valve 28. A second pneumatically-actuated hydraulic valve or recirculation valve 36 is provided in recirculation return line 14 for enabling and disabling recirculation of the LNG to cool meter 24 and the lines within the dispenser before supplying the LNG to the vehicle. Recirculation valve 36 is controlled by controller 110 via an actuator valve **36*a*. Actuator valve 36*a* is an electrically-actuated pneumatic valve. The use of such a valve system allows the pneumatic recirculation valve 36 to be located in the hazardous area of dispenser 5, while electrically-actuated pneumatic actuator valve 36*a* may be located in the electrical cabinet, which is protected from the hazardous area of dispenser 5. A check valve 38 may also be provided in recirculation return line 14**.

As noted above, the system further includes vent line 16, which branches from supply line 12 between first valve 28 and pressure sensor 30. Vent line 16 includes a third pneumatically-actuated hydraulic valve or vent valve 40 for enabling and disabling venting of vapors from the vehicle. Vent valve 40 is controlled by controller 110 via an actuator valve **40*a*. Actuator valve 40*a* is an electrically-actuated pneumatic valve. The use of such a valve system allows the pneumatic vent valve 40 to be located in the hazardous area of dispenser 5, while electrically-actuated pneumatic actuator valve 40*a* may be located in the electrical cabinet which is protected from the hazardous area of dispenser 5**.

Dispenser 5 may further include a separate vehicle vent hose 42 having a nozzle 44 for coupling to a vehicle vent outlet. If such a vent hose 42 is provided, it is coupled to vent line 16 via a check valve 46.

Dispenser 5 further includes first, second, and third pressure relief valves 50, 52, and 54, which are coupled to pressure relief line 18. First pressure relief valve 50 is located in supply line 12 between manual valve 20 and meter 24. Second pressure relief valve 52 is located in supply line 12 between first valve 28 and the branch to vent line 16. Third pressure relief valve 54 is located in recirculation return line 14 between manual valve 22 and second valve 36. The pressure relief valves may open and vent to line 18 when the pressure in the respective lines to which they are connected exceeds a predetermined pressure of, for example, 275 psi.

One of the concerns that arises with the system shown in FIG. 1 is the presence of the recirculation return path 14 and the vent path 16 due to the fact that, when filling the vehicle tank, LNG that flows through meter 24 may be diverted through one of these other paths; meaning that the user is not getting all of the LNG that he/she is paying for. This could occur through intentional tampering with the valves 36 and 40 or through improper operation of valves 36 and 40 not closing completely. The embodiments described in more detail below address this issue by software modifications to controller 110 that verify the integrity of the recirculation valve, vent valve, pressure relief valve 52 and fill hose using existing hardware, thereby eliminating the need for more expensive alternative hardware solutions.

Figure 2:
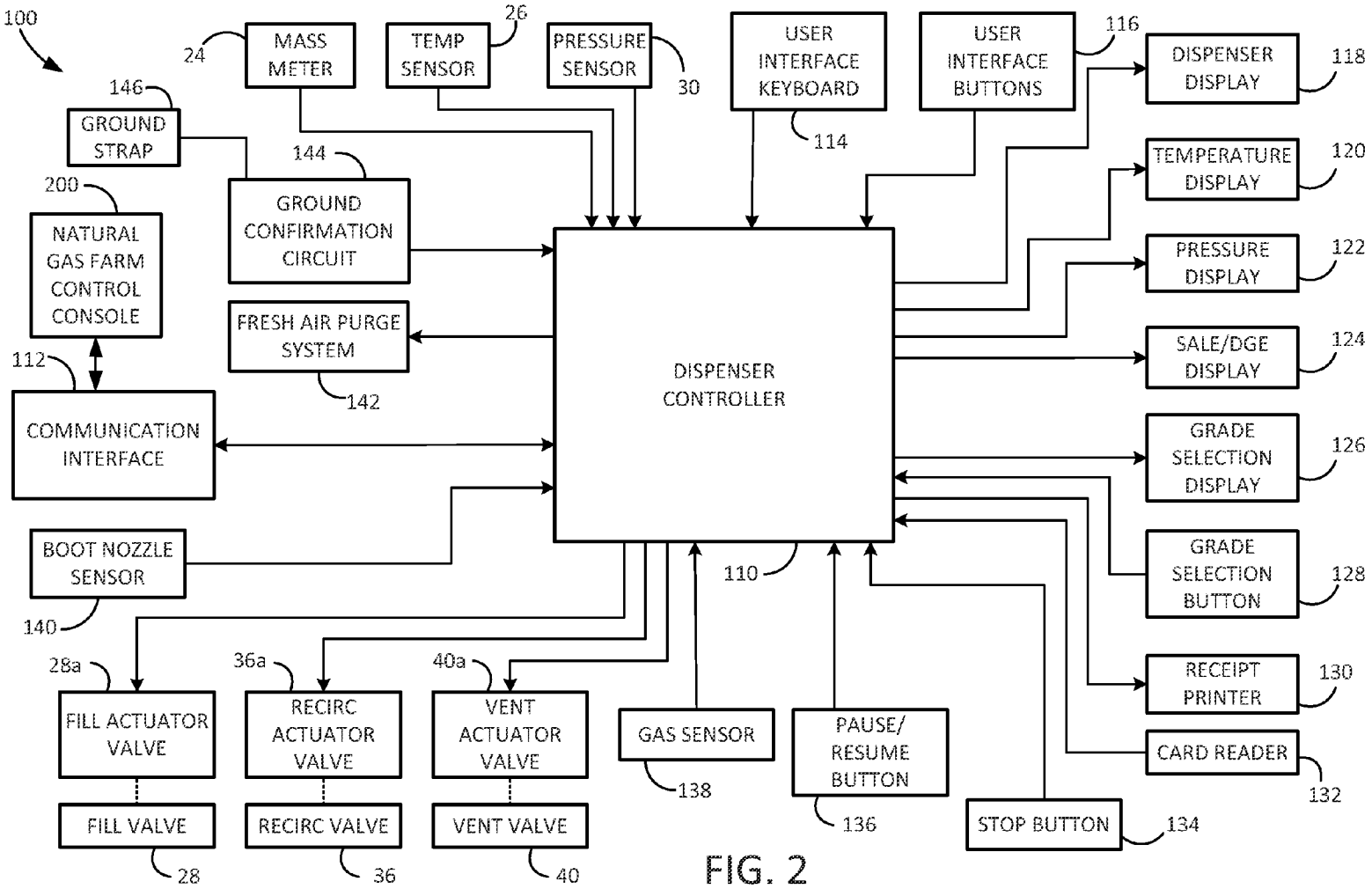
FIG. 2 is an electrical circuit diagram in block form of electrical components of a dispenser according to some of the embodiments.

Having generally described the basic structure of the LNG flow control components 10 of a dispenser 5, reference is made to FIG. 2 which shows the electronic components 100 of dispenser 5.

As already mentioned, dispenser 5 includes dispenser controller 110, mass meter 24, temperature sensor 26, pressure sensor 30, fill valve 28, fill actuator valve 28*a*, recirculation valve 36, recirculation actuation valve 36*a*, vent valve 40, and vent actuator valve 40*a*. Dispenser controller 110 may comprise one or more of: microprocessors or equivalents thereof, programmed logic arrays, digital-to-analog converters, analog-to-digital converters, clocks, memory, buffers, and any other analog or digital circuitry to perform the functions described herein.

Dispenser 5 further includes a communication interface 112 that enables controller 110 to send and receive communications to and from natural gas farm 200. According to one embodiment, the communication interface 112 and natural gas farm 200 may be coupled to one another through a network and communicate with one another using a novel PLC communication protocol that is described further below.

Figure 3:
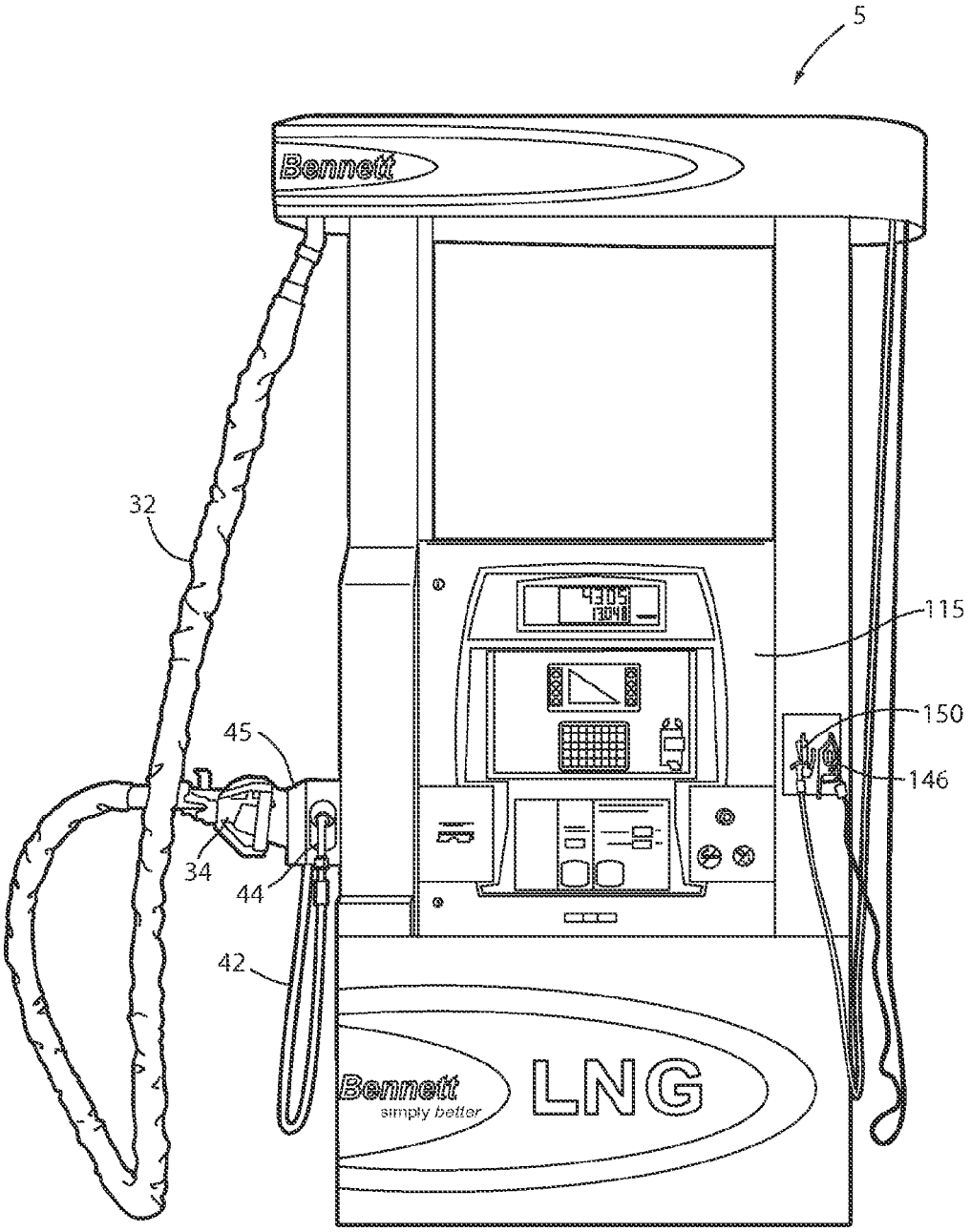
FIG. 3 is an elevational view of a front of an LNG dispenser in which the embodiments described herein are implemented.
Figure 4:
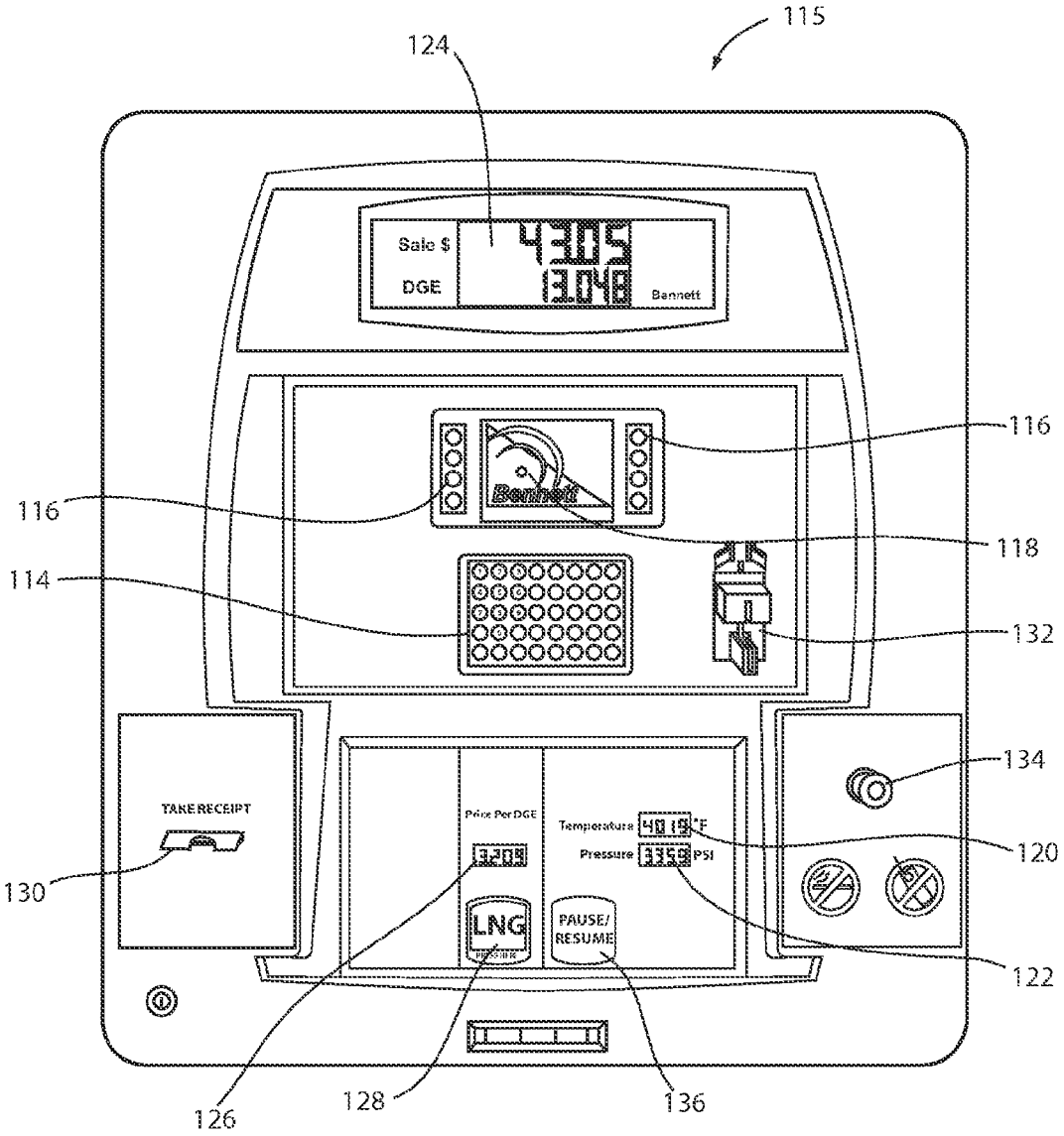
FIG. 4 is an elevational view of a close up of a portion of the front of the LNG dispenser of FIG. 3.
Figure 5:
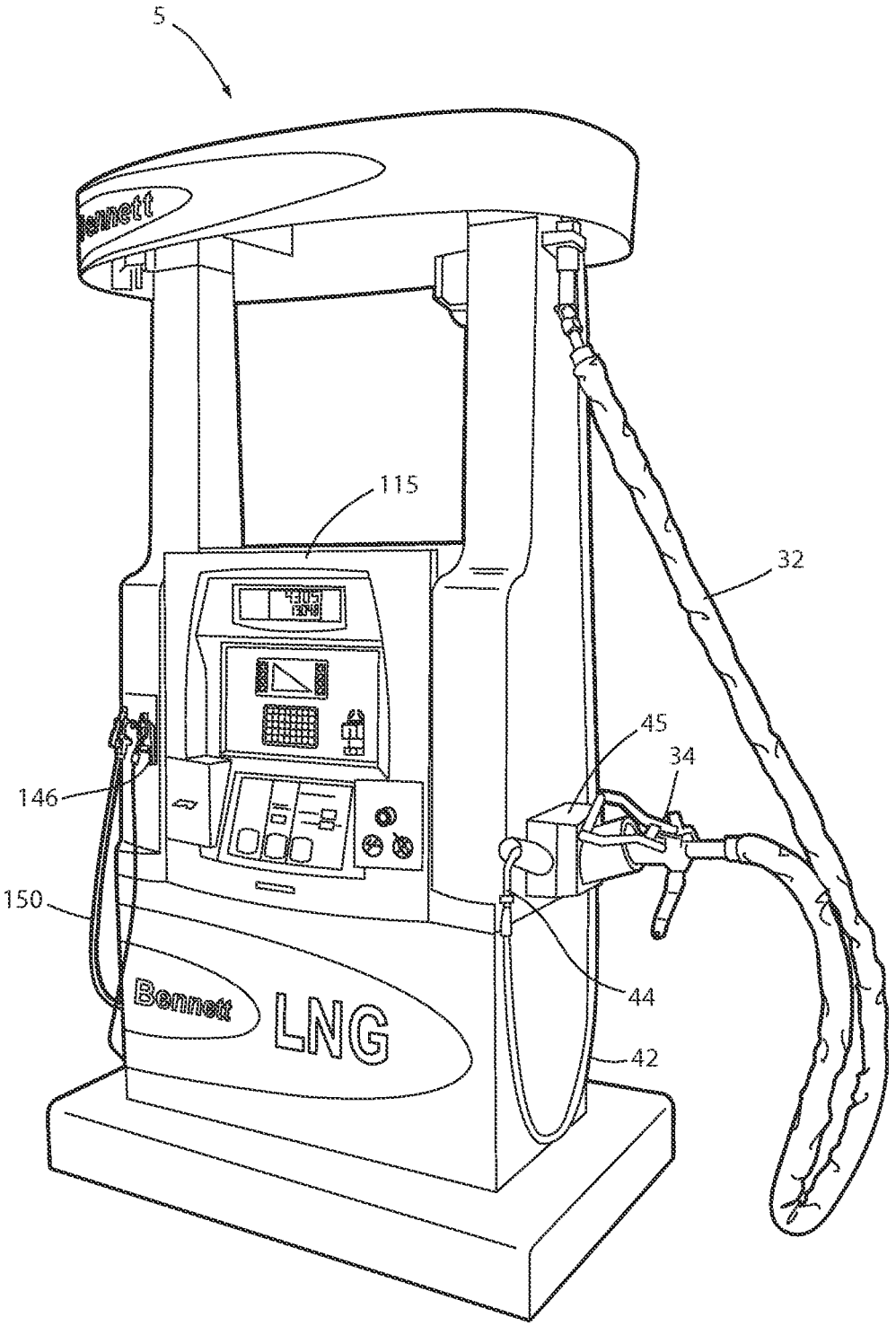
FIG. 5 is a perspective view of the front and side of the LNG dispenser of FIG. 3.

As also shown in FIGS. 3-5, dispenser 5 may further include a ground strap 146, and the aforementioned fill hose 32, fill nozzle 34, vent hose 42, vent nozzle 44, and a user interface section 115 including a user interface keyboard 114, user interface buttons 116, a dispenser display 118, a temperature display 120, a pressure display 122, a sale/DGE display 124, one or more grade selection displays 126, one or more grade selection buttons 128, a receipt printer 130, a card reader 132, a stop button 134, and a pause/resume button 136. In general, keyboard 114 is provided so that a user may type messages that appear on dispenser display 118 to be added to the fuel sale record for use by their employer. User interface buttons 116 are preferably capacitive touch switches to reduce the risk of a spark. Buttons 116 and dispenser display 118 are multifunctional and their uses are described in part below.

Temperature display 120 is provided to display the temperature of the LNG as sensed by temperature sensor 26. This allows the user to see the temperature of the LNG fuel supplied to the vehicle tank. Similarly, pressure display 122 is provided to display the pressure of the LNG fuel as sensed by pressure sensor 30.

Sale/DGE display 124 is provided to display the sale cost (in dollars) and the diesel gallon equivalent (DGE) or mass in pounds or kilograms of the LNG mass provided to the vehicle tank as measured by mass meter 24. The DGE information may be displayed on an alternative existing display of dispenser such as displays 118, 120, 122, and 126 or on an additional display. Stop button 134 is provided for initiating an emergency stop. The functions of pause/resume button 136 and ground strap 146 are described below.

Dispenser 5 may further include an optional gas sensor 138, a boot nozzle sensor 140, a fresh air purge system 142, a ground confirmation circuit 144, and a compressed air hose 150.

Gas sensor 138 is provided for sensing methane gas in the environment outside the dispenser cabinet. If gas is sensed, controller 110 performs a shutdown procedure at least until such time that gas is no longer sensed. This is an improvement over prior systems where a gas sensor was coupled to a remote controller that would shut down the dispenser in a less than orderly manner.

Boot nozzle sensor 140 senses when the nozzle 34 is inserted in a nozzle boot 45 and provides this information to controller 110 for reasons described below. In essence, boot nozzle sensor 140 serves as an on/off switch. Nozzle boot 45 may also include a locking mechanism for locking nozzle 34 in nozzle boot 45 when not in use.

Fresh air purge system 142 is provided in the upper chamber of the dispenser cabinet where the electrical components 100 are located to purge the air in this chamber with fresh air. This maintains a positive pressure in the electrical chamber which keeps any methane gas from reaching the electrical components.

Ground confirmation circuit 144 is coupled to ground strap 146 and is configured to confirm that the ground strap 146 has been properly grounded to the vehicle. Such a ground confirmation circuit may be a contact on the ground clamp that is coupled to the controller for sensing when the ground clamp is properly connected to the vehicle fuel tank. Alternatively, commercially available ground confirmation systems can be integrated for use with the dispenser.

Compressed air hose 150 is provided for the user to blow out nozzle 34 and the receptacle before fueling.

As noted above, a novel protocol is used for communications between dispenser 5 and natural gas farm 200. The specifics of the protocol are not pertinent to the understanding of the present invention; however, it should be understood that the protocol defines a message format for sending messages over a network existing not only between dispenser 5 and natural gas farm 200, but also between natural gas farm 200 and any other dispensers to which it provides natural gas. In general, the protocol defines a message format whereby the number and relative position of various bits within the message constitute different portions of the message. Thus, the message may include an identification of the dispenser and status bits. In messages sent from dispenser 5 to natural gas farm 200, such status bits may include any one or more of the following: "authorized," "saturated/unsaturated," "sale complete," "recirculating," and "product request," as described further below. Additional details of the protocol are disclosed in U.S. Provisional Application No. 61/793,256, entitled "IMPROVED FUEL DISPENSERS" filed on Mar. 15, 2013, by Sarah Ann Lambrix et al., the entire disclosure of which is incorporated herein by reference.

Having described the structural components of dispenser 5, some of the operations thereof are now described. First, the user is informed via dispenser display 118 that the dispenser may vent the vehicle tank back to the station. This is typically done to remove vaporized gas from the vehicle tank so as to prevent over-pressurizing the tank when filling it with LNG. The user may then be prompted to press an "accept" button, which may be one of the user interface buttons 116 adjacent display 118, to begin the sale. Next, controller 110 responds to the pressing of the accept button by verifying the integrity of vent valve 40 and fill hose 32. This is done by closing vent valve 40 and opening fill valve 28, which will pressurize fill hose 32. Fill valve 28 is then closed which contains the pressure within the piping between fill valve 28 and vent valve 40. Controller 110 then monitors the pressure in fill hose 32 for several seconds using pressure sensor 30 to ensure that the pressure remains steady and that there are no leaks in hose 32, fill valve 28, pressure relief valve 52 or vent valve 40. If controller 110 detects a leak, the sale will be aborted.

Thereafter, the user is given the option of viewing some training screens on dispenser display 118. The training screens may be graphic training illustrations such as those disclosed in U.S. Provisional Application No. 61/793,256, entitled "IMPROVED FUEL DISPENSERS" filed on Mar. 15, 2013, by Sarah Ann Lambrix et al., the entire disclosure of which is incorporated herein by reference. Once training is completed, the user may authorize the dispenser using any desired method (i.e., using a credit card in card reader 132). Controller 110 responds by setting an "authorized" bit in the PLC communications back to natural gas farm 200.

Next, the user may connect fueling nozzle 34 and ground strap 146 to the vehicle. Ground confirmation circuit 144 may generate a signal to controller 110 upon confirming that ground strap 146 is properly connected to the vehicle ground terminal. Upon receiving such confirmation, controller 110 responds by opening vent valve 40 and closing fill valve 28. The vehicle tank then begins to vent pressure through fill hose 32 and/or separate vent hose 42. Once the vehicle tank has vented to acceptable pressure, the user is then prompted to select a grade of LNG by pressing the grade select button 128. Controller 110 then sets the "saturated/unsaturated" bit to the selected grade, displays the selected grade in grade selection display 126, and clears the "sale complete" bit if set in the PLC communications back to natural gas farm 200. Controller 110 performs a reset cycle and clears the current sale data.

Controller 110 then opens recirculation valve 36 and sets the "product request" and "recirculating" bits in PLC communications back to natural gas farm 200. Controller 110 then recirculates the LNG product until the temperature sensor 26 readings are appropriate for the selected LNG product. Such recirculation is performed to cool down the meter 24 and supply lines within the dispenser to ensure that the LNG is delivered at the proper temperature. Upon reaching the appropriate temperature established by a temperature set point, controller 110 closes the recirculation valve 36 and clears the "recirculating" bit in the PLC communications back to natural gas farm 200. Unlike prior systems that recirculate for a given time period, this embodiment uses the temperature readings from the temperature sensor to determine when to stop recirculation. In this way, the system will automatically take into account the variance of ambient temperature of the dispenser as well as the temperature at the time of recirculation (it may have just finished fueling another vehicle and still be cold).

Controller 110 next verifies the integrity of the recirculation valve 36 and fill valve 28 by pushing the LNG against both closed valves and checking that the LNG passing through the meter 24 at this time does not exceed a certain amount (close to or equal to zero flow). If a leak is detected, the sale is aborted. Otherwise, controller 110 resets meter 24, closes the vent valve 40, and opens fill valve 28. The mass of the metered product is measured on meter 24 and is displayed on sale/DGE display screen 124. Also, the temperature sensed by temperature sensor 26 is displayed on temperature display 120 and the pressure sensed by pressure sensor 30 is displayed on pressure display 122, as discussed further below. If the flow rate falls below the minimum flow rate as measured through meter 24, controller 110 closes fill valve 28 and opens vent valve 40. Controller 110 then clears the "product request" bit in the PLC communications back to natural gas farm 200.

If the pause/resume button 136 is pressed to pause delivery, controller 110 closes fill valve 28 and opens vent valve 40. Controller 110 clears the "product request" bit in the PLC communications back to natural gas farm 200. If the pause/resume button 136 is pressed after the dispenser has been paused, controller 110 opens recirculation valve 36. Controller 110 sets the "product request" and recirculating" bits in the PLC communications back to natural gas farm 200. When the product has reached the target temperature as sensed by temperature sensor 26, controller 110 closes recirculation valve 36 and vent valve 40 and opens fill valve 28. Controller 110 then clears the "recirculating" bit in the PLC communications back to natural gas farm 200. Controller 110 then continues the sale until the handle is lowered and sensed by boot nozzle sensor 140 or the fill limit is reached.

If a dispenser error occurs during the sale, controller 110 closes fill valve 28 and opens vent valve 40. Controller 110 clears the "product request" and "authorized" bits in the PLC communications back to natural gas farm 200.

The user then returns the nozzle 34 to the holder or a nozzle boot 45 and returns the ground strap 146 to the holder. Once the nozzle 34 is returned, controller 110 sets a "sale complete" bit and clears the "authorized" bit in the PLC communications back to natural gas farm 200 and controller 110 returns to idle.

Thus, a method is provided for verifying integrity of a recirculation valve in a recirculation line of an LNG dispenser, where the method comprises: closing the recirculation valve and a fill valve in a supply line that supplies LNG; monitoring a mass of the LNG flowing through the recirculation line to ensure that the mass of the LNG flowing therethrough is less than an acceptable threshold; and aborting any pending sales if the mass of the LNG flowing through the recirculation line is not less than the acceptable threshold.

Moreover, a method is provided for verifying integrity of a vent valve in an LNG dispenser, where the method comprises: prior to connection of a fill hose to a vehicle, closing the vent valve and opening a fill valve in a supply line that supplies LNG to pressurize the piping containing the vent valve 40 and then closing fill valve 28; monitoring the pressure of the LNG within the fill hose to ensure that the pressure remains steady; and aborting any pending sales if the pressure does not remain steady.

By verifying the integrity of the recirculation valve 36, the vent valve 40, the pressure relief valve 52 and the fill hose 32 before proceeding with a sale, the dispenser may ensure that, when filling the vehicle tank, LNG that flows through the meter is not being diverted through either the vent, pressure relief or recirculation paths and thereby satisfy requirements of regulatory agencies including Measurement Canada.

Another concern of Measurement Canada is that LNG could be pushed back to the natural gas farm in the case that a fuel tank pressure rises above the pressure of the farm 200. To address this concern, controller 110 is programmed to monitor a direction of flow in meter 24 and flag an error if any reverse flow is detected during a sale.

As noted above, the temperature of the LNG as measured by temperature sensor 26, is displayed on temperature display 120. Prior dispensers did not include such a display. However, users want the LNG to be as cold as possible so that they know the LNG is going to take longer to vaporize within their vehicle's cryogenic tanks and vent. A pressure display 122 is advantageous on an LNG dispenser because prior to filling, vehicle tanks tend to be under high pressure from remaining vapors, and such vapors if not vented will collapse upon filling. Thus, users like to know the pressure within their tanks prior to and after filling.

Figure 6:
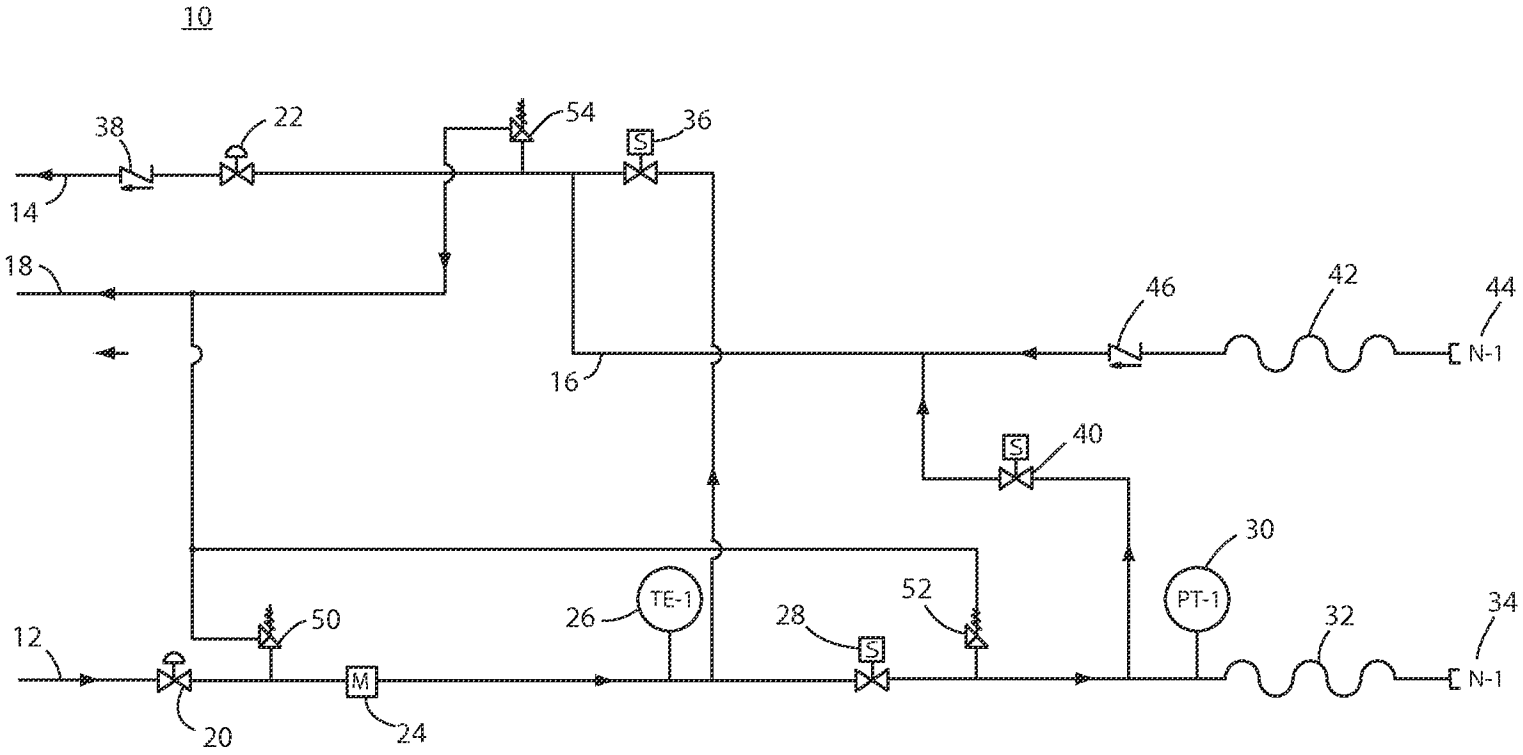
FIG. 6 is a flow diagram in schematic form of LNG flow control components of a dispenser according to another embodiment.

FIG. 6 shows an alternative embodiment of LNG flow control components that may be used in dispenser 5. This alternative embodiment is similar to that shown in FIG. 1 with the exception that a separate vent line 16 is not run to the farm, but instead, vent line 16 is coupled to recirculation return line 14. In this embodiment, the integrity of valves 28 and 40 can be checked during the recirculation process. During recirculation, controller 110 monitors the pressure sensed by pressure sensor 30 for changes. A change in pressure would indicate that either valve 40 or valve 28 is leaking or not fully closed.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the claims as interpreted according to the principles of patent law, including the doctrine of equivalents.

What is claimed is:

1. An LNG dispenser comprising:

a supply line through which LNG is supplied from a natural gas farm to a vehicle tank;

a mass flow meter provided for measuring a mass of LNG flowing through said supply line;

a recirculation line branching from said supply line downstream of said mass flow meter for recirculating LNG from said supply line back to the natural gas farm;

a recirculation valve located in said recirculation line for controlling a flow of LNG through said recirculation line; and a controller for controlling said recirculation valve, wherein said controller verifies integrity of said recirculation valve by closing said recirculation valve and monitoring the mass of the LNG flowing through said mass flow meter to ensure that the mass of the LNG flowing therethrough is less than an acceptable threshold, and wherein, if the mass of the LNG flowing through said mass flow meter is not less than the acceptable threshold, said controller halts any sales.

2. The LNG dispenser of claim 1 and further comprising:

a fill valve located in said supply line for controlling a flow of LNG through said supply line, wherein said controller controls said fill valve, and wherein said recirculation line branches from said supply line between said mass flow meter and said fill valve.

3. The LNG dispenser of claim 1 and further comprising:

a vehicle fill hose coupled to said supply line and having a nozzle configured for coupling to a vehicle tank, said nozzle being closed when not coupled to a vehicle tank;

a fill valve located in said supply line for controlling a flow of LNG through said supply line;

a pressure sensor provided in said supply line for sensing a pressure of the LNG within a portion of said supply line downstream of said fill valve;

a vent line branching from said supply line downstream of said fill valve for venting vapors from a vehicle tank; and a vent valve located in said vent line for controlling a flow of vapors through said vent line, wherein said controller further controls said fill valve and said vent valve, wherein said controller verifies integrity of said vent valve by closing said vent valve and opening said fill valve which pressurizes a portion of said vent line up to said vent valve and then closing said fill valve prior to connection of said fill hose to a vehicle and monitoring the pressure of the LNG to ensure that the pressure remains steady, and wherein, if the pressure does not remain steady, said controller halts any sales.

4. The LNG dispenser of claim 1 and further comprising:

a temperature sensor provided for sensing a temperature of LNG flowing through said supply line, wherein, prior to delivery of LNG to the vehicle tank, said controller opens said recirculation valve while monitoring the temperature of the LNG sensed by said temperature sensor, and wherein said controller closes said recirculation valve when the temperature reaches a target temperature.

5. The LNG dispenser of claim 1, and further comprising:

a temperature sensor provided for sensing a temperature of LNG flowing through said supply line; and a temperature display for displaying the temperature of the LNG as sensed by said temperature sensor.

6. The LNG dispenser of claim 1 and further comprising:

a vehicle fill hose coupled to said supply line and having a nozzle configured for coupling to a vehicle tank, said nozzle being closed when not coupled to a vehicle tank;

a pressure sensor provided for sensing a pressure within said vehicle fill hose as well as in the vehicle tank when coupled thereto; and a pressure display for displaying the pressure within the vehicle tank as sensed by said pressure sensor.

7. The LNG dispenser of claim 1, and further comprising a gas sensor coupled to said controller for sensing methane gas in proximity to the dispenser, wherein if gas is sensed, said controller performs a shutdown procedure until such time that methane gas is no longer sensed by said gas sensor.

8. The LNG dispenser of claim 1, wherein said recirculation valve is a pneumatically-actuated hydraulic valve, which is controlled by said controller via an electrically-actuated pneumatic valve.

9. An LNG dispenser comprising:

a vehicle fill hose having a nozzle configured for coupling to a vehicle tank, said nozzle being closed when not coupled to a vehicle tank;

a supply line through which LNG is supplied from a natural gas farm to a vehicle tank through said vehicle fill hose;

a fill valve located in said supply line for controlling a flow of LNG through said supply line;

a pressure sensor provided in said supply line for sensing a pressure of the LNG within a portion of said supply line downstream of said fill valve;

a vent line branching from said supply line downstream of said fill valve for venting vapors from a vehicle tank;

a vent valve located in said vent line for controlling a flow of vapors through said vent line;

a controller configured to control said fill valve and said vent valve, wherein said controller verifies integrity of said vent valve by closing said vent valve and opening said fill valve which pressurizes a portion of said vent line up to said vent valve and then closing said fill valve prior to connection of said fill hose to a vehicle and monitoring the pressure of the LNG to ensure that the pressure remains steady, and wherein, if the pressure does not remain steady, said controller halts any sales.

10. The LNG dispenser of claim 9 and further comprising a pressure relief valve located in said supply line between said fill valve and said fill hose, wherein said controller verifies integrity of said pressure relief valve at the same time as verifying integrity of said vent valve.

11. The LNG dispenser of claim 9 and further comprising:

a temperature sensor provided for sensing a temperature of LNG flowing through said supply line, a recirculation line branching from said supply line downstream of said temperature sensor for recirculating LNG from said supply line back to the natural gas farm; and a recirculation valve located in said recirculation line for controlling a flow of LNG through said recirculation line, wherein, prior to delivery of LNG to the vehicle tank, said controller opens said recirculation valve while monitoring the temperature of the LNG sensed by said temperature sensor, and wherein said controller closes said recirculation valve when the temperature reaches a target temperature.

12. The LNG dispenser of claim 9, and further comprising:

a temperature sensor provided for sensing a temperature of LNG flowing through said supply line; and a temperature display for displaying the temperature of the LNG as sensed by said temperature sensor.

13. The LNG dispenser of claim 9 and further comprising:

a pressure display for displaying the pressure within the vehicle tank as sensed by said pressure sensor.

14. An LNG dispenser comprising:

a supply line through which LNG is supplied from a natural gas farm to a vehicle tank;

a temperature sensor provided for sensing a temperature of LNG flowing through said supply line;

a recirculation line branching from said supply line downstream of said temperature sensor for recirculating LNG from said supply line back to the natural gas farm;

a recirculation valve located in said recirculation line for controlling a flow of LNG through said recirculation line; and a controller for controlling said recirculation valve, and, prior to delivery of LNG to the vehicle tank, said controller opens said recirculation valve while monitoring the temperature of the LNG sensed by said temperature sensor, and wherein said controller closes said recirculation valve when the temperature reaches a target temperature.

15. The LNG dispenser of claim 14 and further comprising:

a fill valve located in said supply line downstream of said recirculation line for controlling a flow of LNG through said supply line to a vehicle tank, wherein said controller controls said fill valve, and prior to delivery of LNG to the vehicle tank, said controller closes said fill valve while opening said recirculation valve and monitoring the temperature of LNG, and wherein said controller opens said fill valve after closing said recirculation valve when the temperature reaches the target temperature.

16. The LNG dispenser of claim 14, and further comprising:

a temperature display for displaying the temperature of the LNG as sensed by said temperature sensor.

17. The LNG dispenser of claim 14 and further comprising:

a vehicle fill hose coupled to said supply line and having a nozzle configured for coupling to a vehicle tank, said nozzle being closed when not coupled to a vehicle tank;

a pressure sensor provided for sensing a pressure within said fill hose as well as in the vehicle tank when coupled thereto; and a pressure display for displaying the pressure within the vehicle tank as sensed by said pressure sensor.

18. An LNG dispenser comprising:

a supply line through which LNG is supplied from a natural gas farm to a vehicle tank;

a temperature sensor provided for sensing a temperature of LNG flowing through said supply line; and a temperature display for displaying the temperature of the LNG as sensed by said temperature sensor.

19. The LNG dispenser of claim 18 and further comprising:

a vehicle fill hose coupled to said supply line and having a nozzle configured for coupling to a vehicle tank, said nozzle being closed when not coupled to a vehicle tank;

a pressure sensor provided for sensing a pressure within said fill hose as well as in the vehicle tank when coupled thereto; and a pressure display for displaying the pressure within the vehicle tank as sensed by said pressure sensor.

20. An LNG dispenser comprising:

a vehicle fill hose having a nozzle configured for coupling to a vehicle tank, said nozzle being closed when not coupled to a vehicle tank;

a supply line through which LNG is supplied from a natural gas farm to a vehicle tank through said vehicle fill hose;

a fill valve located in said supply line for controlling a flow of LNG through said supply line;

a pressure sensor provided in said supply line for sensing a pressure of the LNG within a portion of said supply line downstream of said fill valve;

a vent line branching from said supply line downstream of said fill valve for venting vapors from a vehicle tank;

a vent valve located in said vent line for controlling a flow of vapors through said vent line;

a recirculation line branching from said supply line upstream of said fill valve for recirculating LNG from said supply line back to the natural gas farm;

a recirculation valve located in said recirculation line for controlling a flow of LNG through said recirculation line; and a controller for controlling said fill valve, said recirculation valve, and said vent valve, wherein said controller verifies integrity of said vent valve and said fill valve by closing said vent valve and said fill valve while opening said recirculation valve and monitoring the pressure of the LNG to ensure that the pressure remains steady, and wherein, if the pressure does not remain steady, said controller halts any sales.

* * * * *